US007004099B2

(12) United States Patent
Iijima et al.

(10) Patent No.: US 7,004,099 B2
(45) Date of Patent: Feb. 28, 2006

(54) HYBRID-POWERED UNDERWATER SCOOTER

(75) Inventors: Yoshihiro Iijima, Saitama (JP); Keiji Iino, Saitama (JP); Masayuki Osumi, Saitama (JP); Hiroshi Sueshige, Saitama (JP); Hiroaki Hasebe, Saitama (JP)

(73) Assignee: Honda Motor Co., Ltd, Tokyo (JP)

( * ) Notice: Subject to any disclaimer, the term of this patent is extended or adjusted under 35 U.S.C. 154(b) by 0 days.

(21) Appl. No.: 11/102,144

(22) Filed: Apr. 8, 2005

(65) Prior Publication Data

US 2005/0223961 A1 Oct. 13, 2005

(30) Foreign Application Priority Data

Apr. 9, 2004 (JP) ..... 2004-116156

(51) Int. Cl.
*B63C 11/46* (2006.01)

(52) U.S. Cl. ..... 114/315; 114/242

(58) Field of Classification Search ..... 114/242, 114/315, 337
See application file for complete search history.

(56) References Cited

U.S. PATENT DOCUMENTS

| | | | | |
|---|---|---|---|---|
| 3,789,788 | A * | 2/1974 | Peroni | 114/315 |
| 4,348,976 | A * | 9/1982 | Gilbert | 114/55.51 |
| 4,813,367 | A * | 3/1989 | Stevenson | 114/315 |
| 5,394,820 | A | 3/1995 | Dach | |
| 5,577,456 | A * | 11/1996 | Kobayashi et al. | 114/315 |
| 5,782,664 | A * | 7/1998 | Casters | 441/65 |

FOREIGN PATENT DOCUMENTS

| | | |
|---|---|---|
| JP | 01-101294 | 4/1989 |

* cited by examiner

*Primary Examiner*—Jesus D. Sotelo
(74) *Attorney, Agent, or Firm*—Carrier, Blackman & Associates, P.C.; William D. Blackman; Joseph P. Carrier

(57) ABSTRACT

An underwater scooter is provided with an engine enclosed in a watertight vessel and an electric motor enclosed in the watertight vessel and connected to the output shaft of the engine, and a propeller disposed upon a main frame and connected to the output shaft of the motor to be driven and turned by at least one of the engine and the motor so as to propel the scooter. In other words, the scooter is a hybrid type having the engine and electric motor as the drive power of the propeller. With this, the operator can easily re-start, once stopped on the surface of the water or underwater. Moreover, since the propeller can be driven even by the engine, a distance of travel is elongated with less increased weight, when compared to the case that the propeller is driven solely by the engine.

6 Claims, 13 Drawing Sheets

HYBRID-POWERED UNDERWATER SCOOTER

The present invention claims priority under 35 USC 119 based on Japanese patent application JP 2004-116156, filed Apr. 9, 2004. The complete disclosure of Japanese patent application JP 2004-116156 is hereby incorporated by reference.

BACKGROUND OF THE INVENTION

1. Field of the Invention

This invention relates to an underwater scooter that can travel on the surface of the water or underwater.

2. Description of the Related Art

Underwater scooters that can travel on the surface of the water or underwater under the control of an operator (diver) have been proposed in the past. This type of underwater scooter typically generates thrust by an internal combustion engine or electrical motor that drives a propeller as the drive power unit (power source). Moreover, it is provided with handle grips that are held onto by the operator, in a constitution such that it tows an operator holding onto the grips and assists their forward motion, as taught in U.S. Pat. No. 5,394,820 and Japanese Patent Publication No. Hei 4(1992)-17832, for example.

The output shafts of internal combustion engines or electric motors mounted on the underwater scooters are usually directly connected to the propellers Therefore, in order to stop the running of the underwater scooters, the operation of the engine or motor must be made off.

Meanwhile, most engines mounted on the underwater scooters are started by pulling recoil starters hard. Since the operator's posture is likely to be unstable on the surface of the water or underwater, it is difficult for the operator to re-start the engine once stopped, thereby rendering the operation to resume running of the scooter tedious.

On the other hand, the electric motors are easily started on even on the surface of the water or underwater by simply turning the switch on. However, if the electric motor is used as the drive power unit of the underwater scooter, if a long distance travel is desired, the capacity of battery must be increased. This is disadvantageous in terms of weight, when compared to the case that the engine is used as the drive power unit, where the same purpose is achieved by increasing fuel tank capacity. Thus, when the electric motor is used and a distance of travel is increased, a heavier size of power source is unavoidable.

SUMMARY OF THE INVENTION

One object of the invention is therefore to overcome these problems and provide an underwater scooter that can make easy to resume running, once stopped, on the surface of the water or underwater, while enabling a user to elongate a distance of travel with less increased weight.

In order to achieve the object, there is provided an underwater scooter for enabling an operator when seated thereon, to travel on a surface of water or underwater, comprising: a main frame on which the operator is to be seated; a watertight vessel disposed upon the main frame; an internal combustion engine enclosed in the watertight vessel; an electric motor enclosed in the watertight vessel and connected to an output shaft of the engine; and a propeller disposed upon the main frame and connected to an output shaft of the electric motor. The propeller is adapted to be driven and turned by at least one of the engine and the electric motors so as to propel the underwater scooter.

BRIEF DESCRIPTION OF THE DRAWINGS

The above and other objects and advantages of the invention will be more apparent from the following description and drawings, wherein.

DETAILED DESCRIPTION OF THE ILLUSTRATIVE EMBODIMENTS

Here follows a description of selected illustrative embodiments of the underwater scooter according to the invention, made with reference to the appended drawings.

Figure 1:
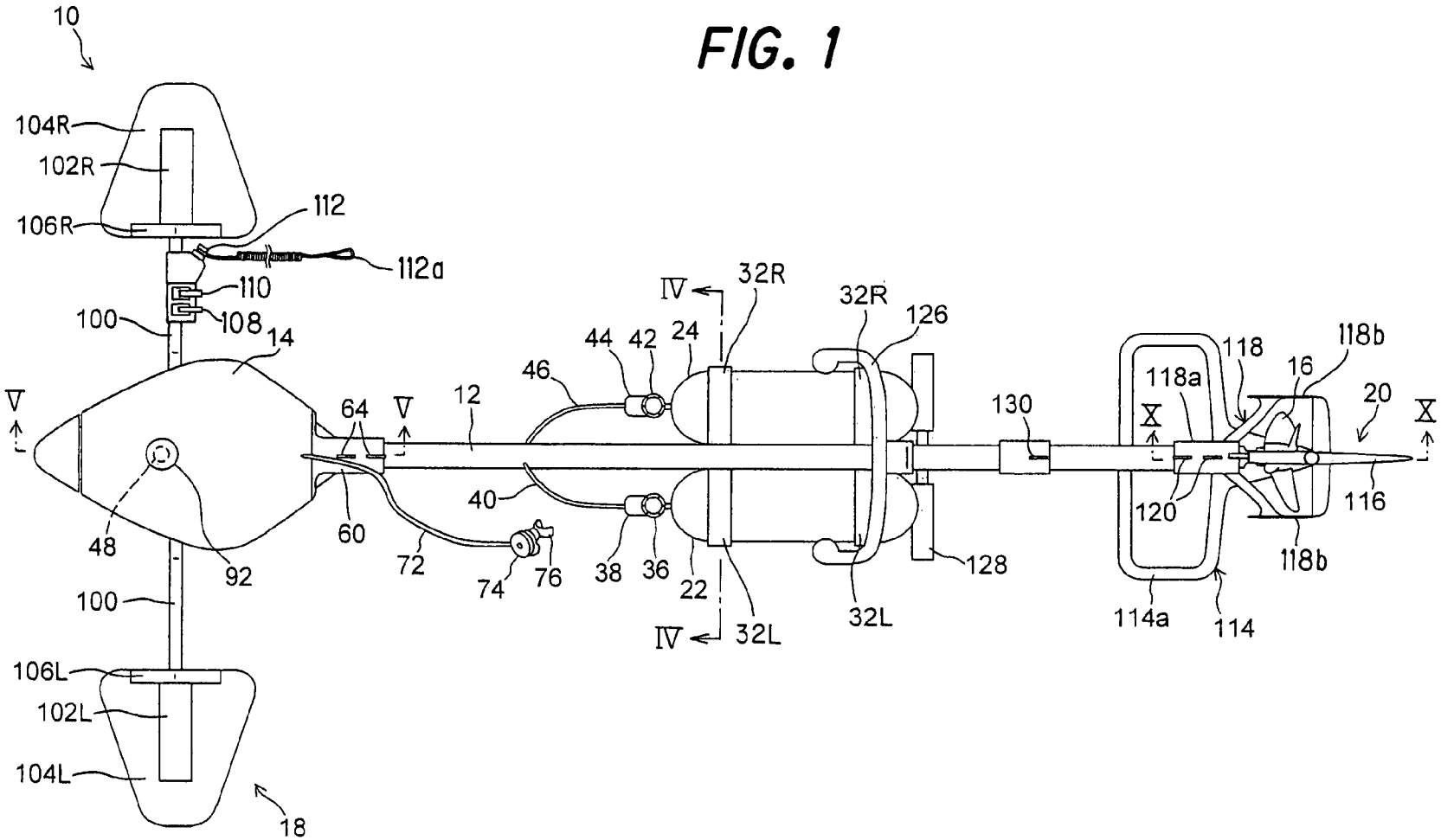
FIG. 1 is a top plan view of an underwater scooter according to a first embodiment of the invention.

FIG. 1 is a top view of an underwater scooter according to a first embodiment of the invention. In addition, FIG. 2 is a left side view of the underwater scooter shown in FIG. 1, while FIG. 3 is a front view of the underwater scooter shown in FIG. 1.

Figure 2:
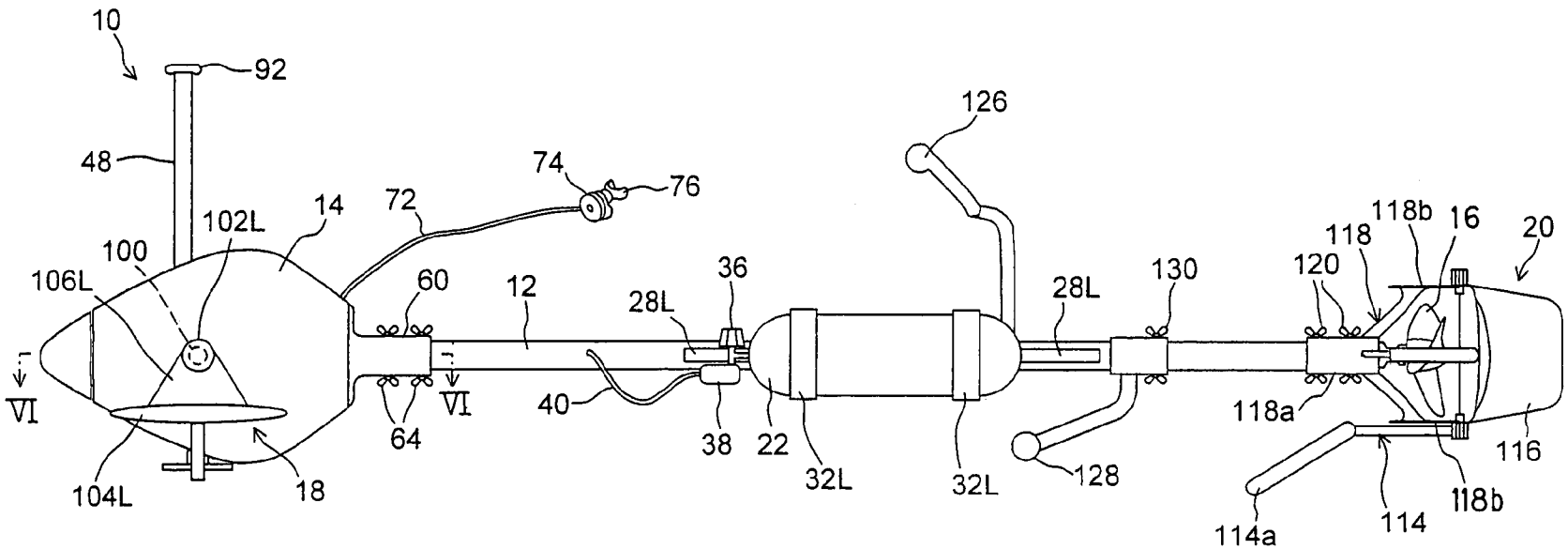
FIG. 2 is a left side view of the underwater scooter shown in FIG. 1.
Figure 3:
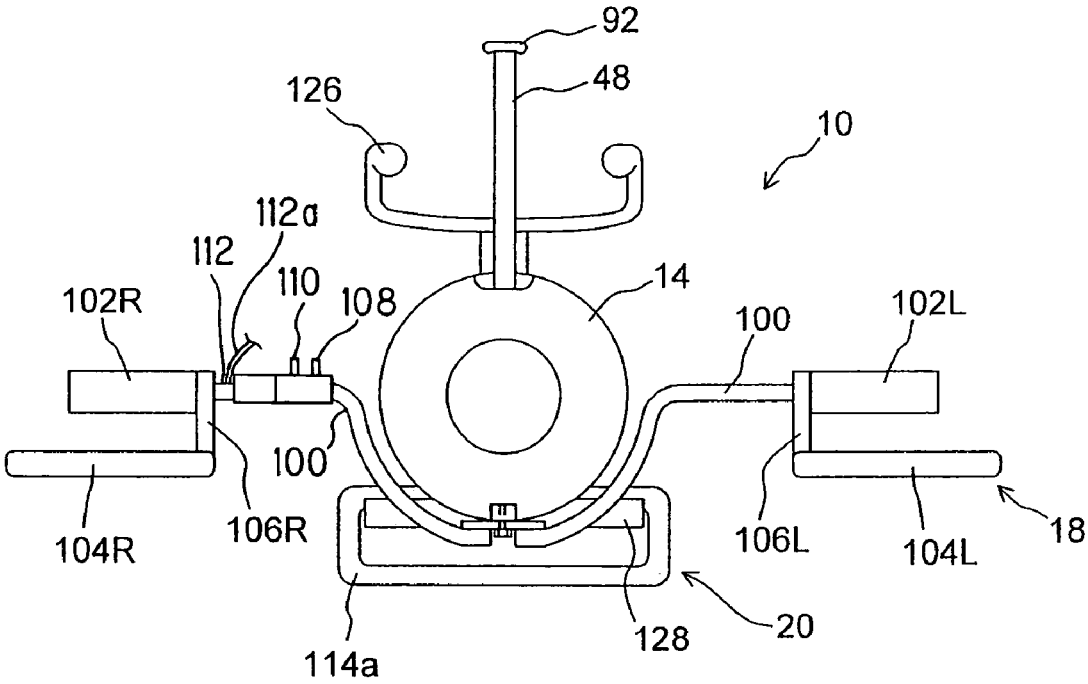
FIG. 3 is a front view of the underwater scooter shown in FIG. 1.

In FIG. 1 through FIG. 3, symbol 10 indicates an underwater scooter. The underwater scooter 10 includes: a cylindrical main frame 12, disposed such that its lengthwise direction is parallel to the direction of forward motion of the underwater scooter 10, and an ovoid watertight (airtight) vessel 14 disposed upon the main frame 12 toward the fore end thereof. The scooter 10 also includes an internal combustion engine (drive power unit (power source); not shown in FIGS. 1–3; hereinafter called the "engine") E enclosed within the interior of the watertight vessel 14, as well as an electric motor (drive power unit (power source); not shown in FIGS. 1–3;) M similarly enclosed within the interior of the watertight vessel 14 and connected to the engine E. The scooter 10 further includes a propeller 16 that is disposed upon the main frame 12 toward the aft end thereof. The propeller 16 is driven and turned by at least one of the engine E and electric motor M to propel the underwater scooter 10. The scooter 10 also includes a driveshaft (not shown in FIGS. 1–3) that passes through the interior of the main frame 12 and that transmits at least one of the outputs of the engine E and electric motor M to the propeller 16, a depth adjusting mechanism 18 that is disposed near the watertight vessel 14 and that adjusts the depth of travel of the underwater scooter 10, and a steering mechanism 20 that is disposed near the propeller 16, and that adjusts the direction of forward motion of the underwater scooter 10. The scooter 10 also includes and a first air tank 22 and second air tank 24 that are disposed upon the main frame 12 between the watertight vessel 14 and propeller 16.

The constituent elements listed above will now be described in detail.

Figure 4:
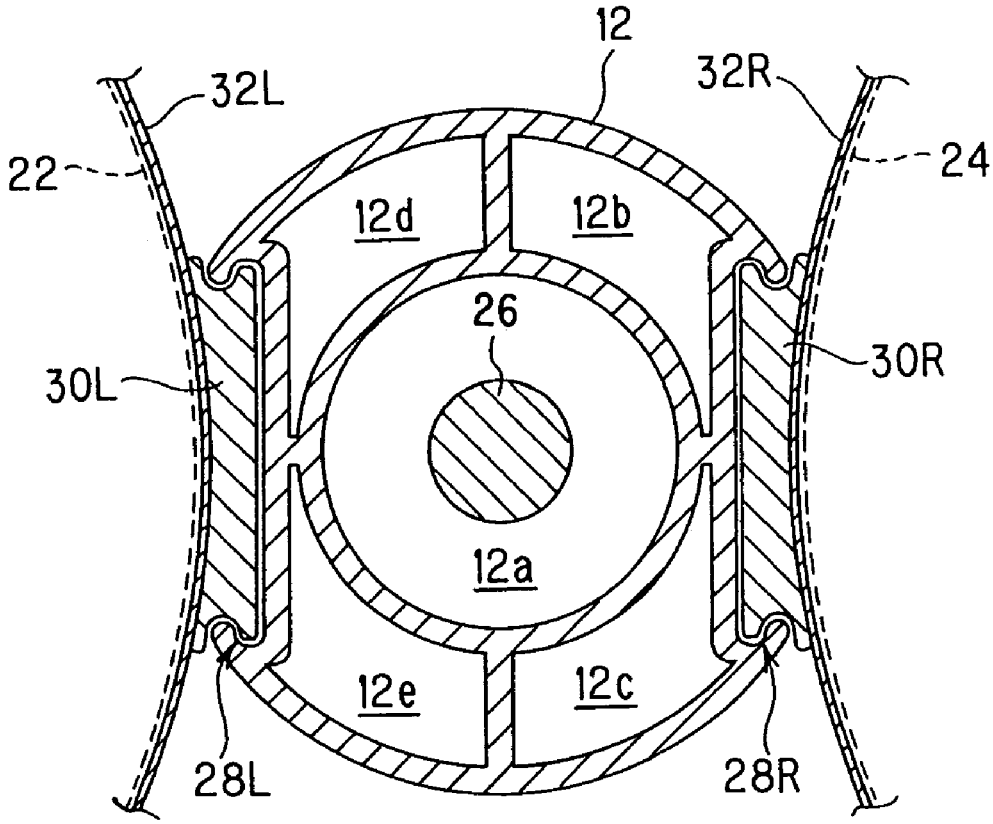
FIG. 4 is an enlarged cross section along the line IV—IV in FIG. 1.

FIG. 4 is an enlarged cross section along the line IV—IV in FIG. 1. As illustrated in the figure, the interior of the main frame 12 is divided by partition walls to form five passages. Each passage is formed as a single contiguous space from the fore end to the aft end of the main frame 12. Among the five passages, the cylindrical first passage 12*a* positioned in the center is the one through which the driveshaft (indicated by the symbol 26) described above passes. In contrast, the second through fifth passages 12*b*, 12*c*, 12*d* and 12*e* formed so as to divide the periphery of the first passage 12*a* serve as paths for the flow of air or exhaust gases as described later.

Grooves 28L and 28R that are substantially C-shaped in cross section (or have the reverse cross section in left-right symmetry) are formed on either side surface of main frame 12. As shown in FIG. 2, groove 28L (and groove 28R positioned on the aft surface) is formed such that it has a stipulated length in the lengthwise direction of main frame 12 (in the direction of forward motion).

Continuing on with the description of FIG. 4, sliders 30L and 30R that are substantially H-shaped in cross section are slidably fitted into the left and right grooves 28L and 28R, respectively. Specifically, the sliders 30L and 30R are constituted so as to be able to slide freely using the protrusions formed at the top edges and bottom edges of the grooves 28L and 28R as rails.

Belts 32L and 32R are provided upon the sliders 30L and 30R, respectively. The first air tank 22 and second air tank 24 described previously are mounted to the sliders 30L and 30R, respectively, by belts 32L and 32R, respectively. Thereby, the first air tank 22 and second air tank 24 are mounted to the main frame 12 such that they are able to slide freely in the lengthwise direction (namely in the direction of forward motion of the underwater scooter 10).

Returning to the description of FIGS. 1–3, the first air tank 22 is connected via a valve 36 to a regulator 38. The regulator 38 is connected via a hose 40 to the interior of the main frame 12 (specifically the second passage 12*b*). On the other hand, the second air tank 24 is connected via a valve 42 to a regulator 44. The regulator 44 is connected via a hose 46 to the interior of the main frame 12 (specifically the third passage 12*c*). Note that the first and second air tanks 22 and 24 may have volumes of roughly 12 liters, for example, and may contain air compressed to high pressure (e.g. roughly 200 atm).

The air contained in the first air tank 22 is depressurized by the regulator 38 to a stipulated pressure (e.g., 10 atm) and then supplied via the hose 40 to the second passage 12*b* in the main frame 12. On the other hand, the air contained in the second air tank 24 is depressurized by the regulator 44 to a stipulated pressure (e.g., 10 atm) and then supplied via the hose 46 to the third passage 12*c* in the main frame 12.

Figure 5:
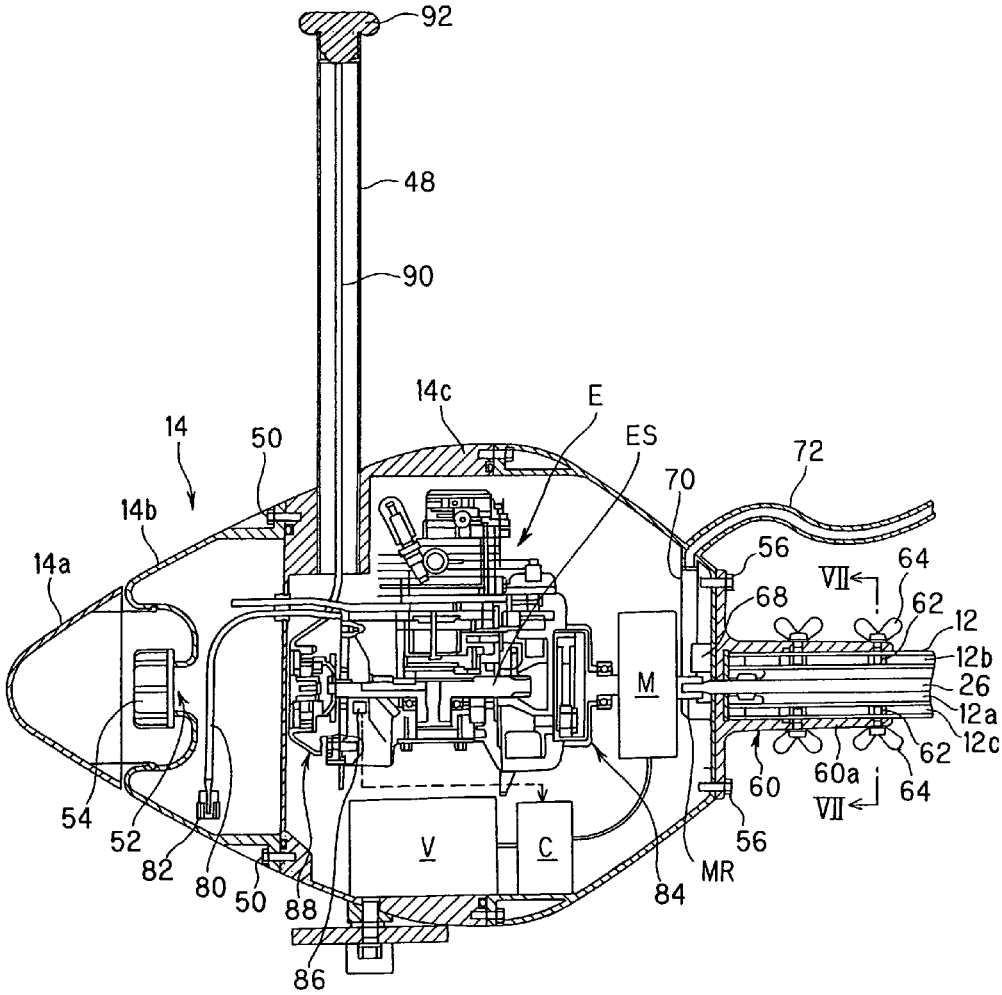
FIG. 5 is an enlarged cross section along the line V—V in FIG. 1.

FIG. 5 is an enlarged cross section along the line V—V in FIG. 1. In addition, FIG. 6 is an enlarged cross section along the line VI—VI in FIG. 2.

Figure 6:
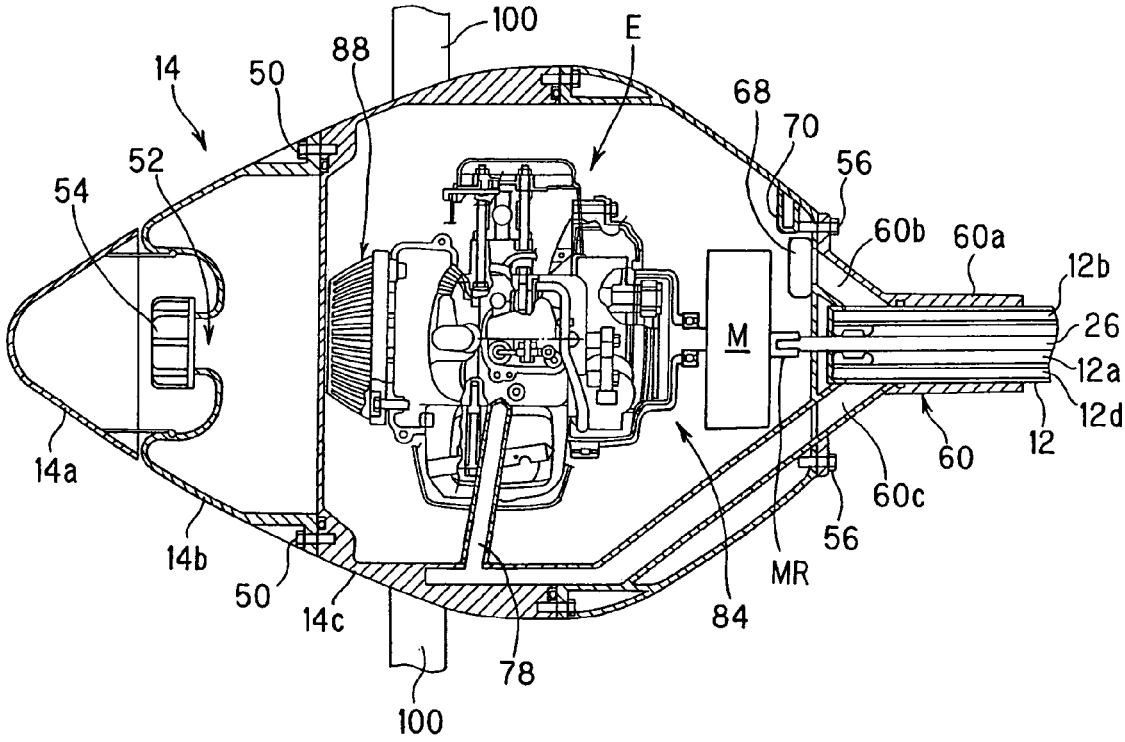
FIG. 6 is an enlarged cross section along the line VI—VI in FIG. 2.

As shown in FIG. 5 and FIG. 6, the watertight vessel 14 comprises three members: a bumper 14*a*, fuel tank 14*b* and a drive power enclosure 14*c*, going from fore to aft in the direction of forward motion.

The engine E is enclosed within the drive power enclosure 14*c*. The engine E may be a one-cylinder spark-ignition gasoline engine with a displacement of roughly 30 cc, for example. The electric motor M is also enclosed within the drive power enclosure 14*c*. Specifically, the electric motor M is a DC brushless motor. In addition, a snorkel 48 that protrudes upward is provided on top of the drive power enclosure 14*c*, and the interior of the drive power enclosure 14*c* communicates with the outside (atmosphere) via this snorkel 48.

The fuel tank 14*b* is mounted by bolts 50 to the front of the drive power enclosure 14*c*, and the fuel tank 14*b* stores the gasoline fuel to be supplied to the engine E. In addition, a filler neck 52 is provided on a hole in the front surface of the fuel tank 14*b*, and a gas cap 54 seals the filler neck 52.

The bumper 14*a* is attached to the front of the fuel tank 14*b* in order to cover the gas cap 54. The bumper 14*a* is made from a material with a hardness less than that of the other members so as to deform and absorb the impact when the underwater scooter 10 may collide with another object. In addition, the bumper 14*a* is made to be removable without the use of tools in order to simplify filling the fuel tank 14*b* with gasoline fuel.

In addition, a connecting member 60 is mounted by bolts 56 to the aft of the drive power enclosure 14*c*. The connecting member 60 is provided with a cylindrical portion 60*a* with an inside diameter roughly equal to the diameter of the main frame 12.

Figure 7:
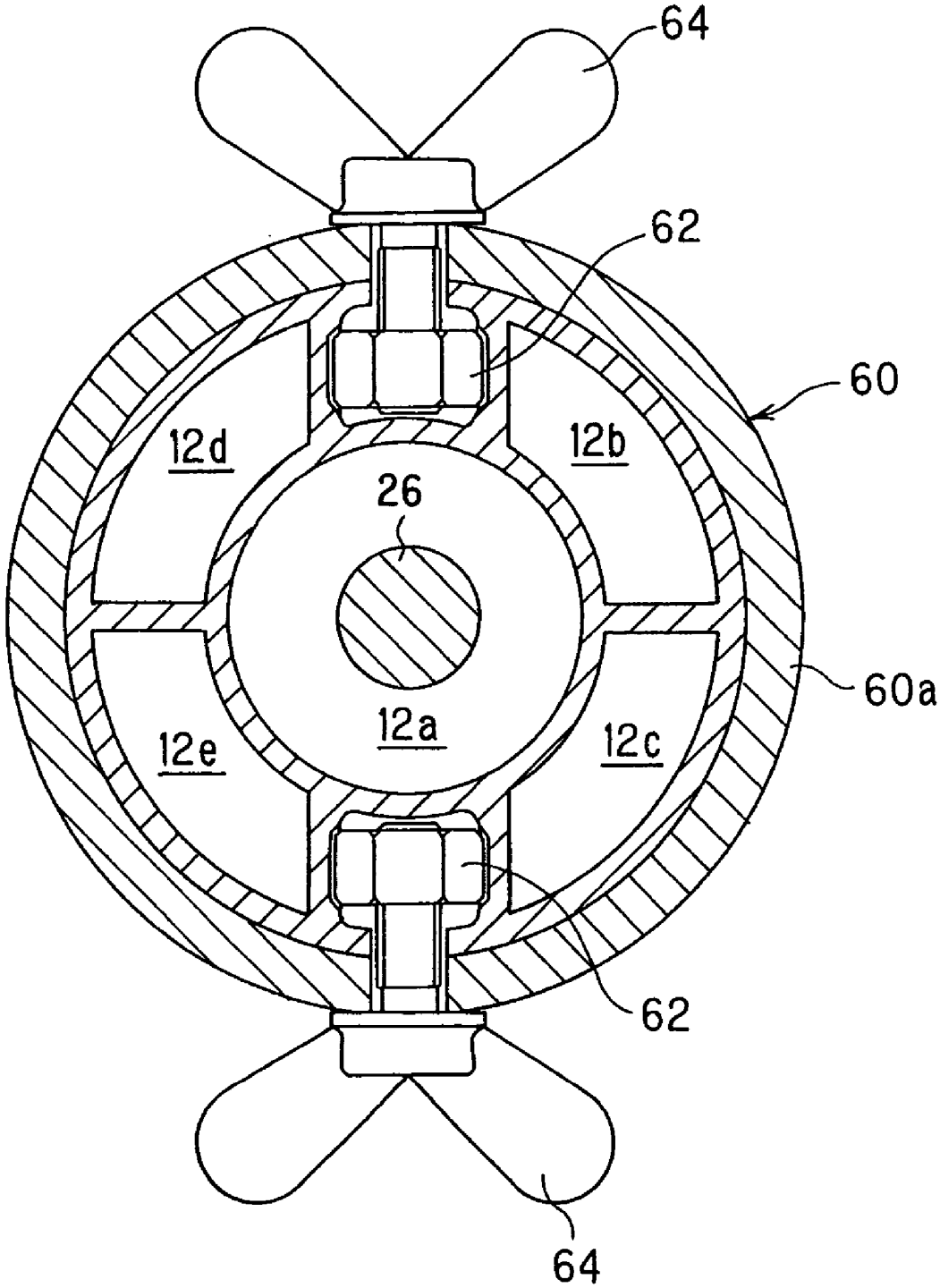
FIG. 7 is an enlarged cross section along the line VII—VII in FIG. 5.

FIG. 7 is an enlarged cross section along the line VII—VII in FIG. 5. As shown in FIG. 7, nuts 62 are enclosed near the tip of the main frame 12. As shown in FIGS. 5–7, the tip of the main frame 12 is inserted into the cylindrical portion 60*a* of the connecting member 60 and wing bolts 64 are screwed into the nuts 62 to mount the watertight vessel 14 to the fore part of the main frame 12 via the connecting member 60. Note that the nuts 62 are surrounded by the partition walls on all sides, and are thus kept from turning.

Returning to the description of FIGS. 5 and 6, the second passage 12*b* of the main frame 12 is connected via a communication passage 60*b* (shown in FIG. 6) formed in the connecting member 60 to a regulator 68 disposed within the watertight vessel 14. In addition, the third passage 12*c* is connected via a communication passage (not shown) formed in the interior of the connecting member 60 and a flow path 70 provided within the watertight vessel 14 to a hose 72 that continues on to the outside of the watertight vessel 14. The end of the hose 72 is connected to a regulator 74 and a mouthpiece 76 is further connected to the regulator 74 (both of which are shown on FIGS. 1 and 2).

The fourth passage 12*d* of the main frame 12 is connected via a communication passage 60*c* formed in the connecting member 60 to the exhaust pipe 78 of the engine E. Note that while this is not shown, a fifth passage 12*e* communicates via a communication passage formed in the connecting member 60 to the interior of the watertight vessel 14.

The engine E is provided with an air intake line (not shown). An air filter is provided near the inlet of the air intake line, and a throttle body (both of which are not shown) is disposed downstream thereof. The throttle body encloses a throttle valve and a carburetor assembly (both of which are not shown) is provided on the upstream side thereof. A fuel pipe or line 80 (shown on FIG. 5) is connected to the carburetor assembly. The fuel pipe 80 communicates with the interior of the fuel tank 14*b* and also its end is connected to a fuel pump 82.

In addition, one end of the crankshaft ES (output shaft; shown in FIG. 5) of the engine E is connected, via a centrifugal clutch 84, to the electric motor M, more specifically to one end of a rotor MR (output shaft) of the electric motor M. The output side of rotor MR is connected to the fore end of the driveshaft 26. The centrifugal clutch 84 transmits the output of the engine E to the rotor RM when the engine speed exceeds the idle speed. Note that the underwater scooter 10 is provided with a throttle lever (explained later) connected to the throttle valve of the engine E that enables for an operator OP (diver) to adjust the speed of the engine E.

The electric motor M is electrically connected to a battery V via a control unit C to be supplied with voltage (e.g., 12 V) and produces output of 70 W or thereabout. As illustrated, the battery V and control unit C are located in the watertight vessel 14 at a position below (in terms of the direction of gravity) the engine E and electric motor M.

On the other hand, a crank angle sensor 86 is mounted to the other end of the crankshaft ES. The crank angle sensor 86 generates a pulse signal once every predetermined crank angles. The pulse signal is inputted to the control unit C. The control unit C comprises a microcomputer and driver circuits and detects or calculates the engine speed NE by counting the number of the inputted pulse signals. The control unit C regulates the direction of current (magnetic poles) and the magnitude of current to be supplied to the coils (not shown) of the electric motor M based on the detected engine speed NE and other parameters and controls the operation of the electric motor M (explained later).

Also, a recoil starter 88 is mounted to the other end of the crankshaft ES. A starter rope 90 for the recoil starter 88 passes through the interior of the snorkel 48 and also a starter grip 92 is provided at its end. The starter grip 92 is constituted such that it can be removably attached to the upper end of the snorkel 48. Specifically, the starter grip 92 is constituted such that it can be inserted into the upper end of the snorkel 48 so that it forms a watertight seal over its opening and also can be freely removed from the upper end. Specifically, when the engine E is to be started, the starter grip 92 is removed from the upper end of the snorkel 48 and the starter rope 90 is pulled. Once the engine E is started, the starter grip 92 is attached to the upper end of the snorkel 48 to seal its opening and prevent water from entering from the snorkel 48.

Figure 8:
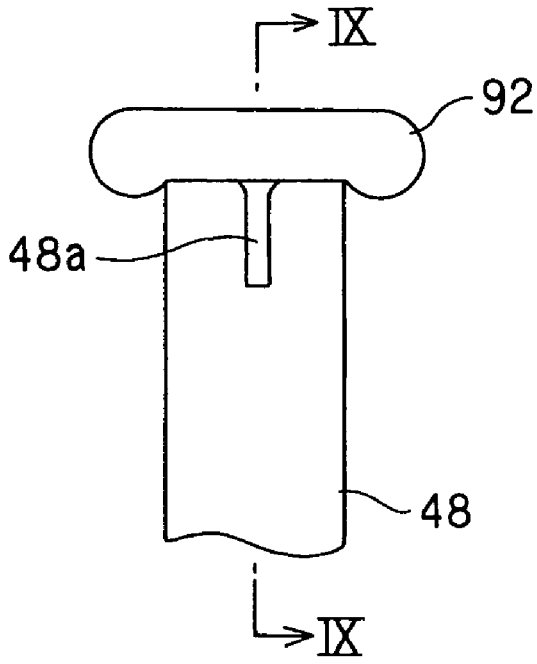
FIG. 8 is an enlargement of the area around the upper end of a snorkel shown in FIG. 2.
Figure 9:
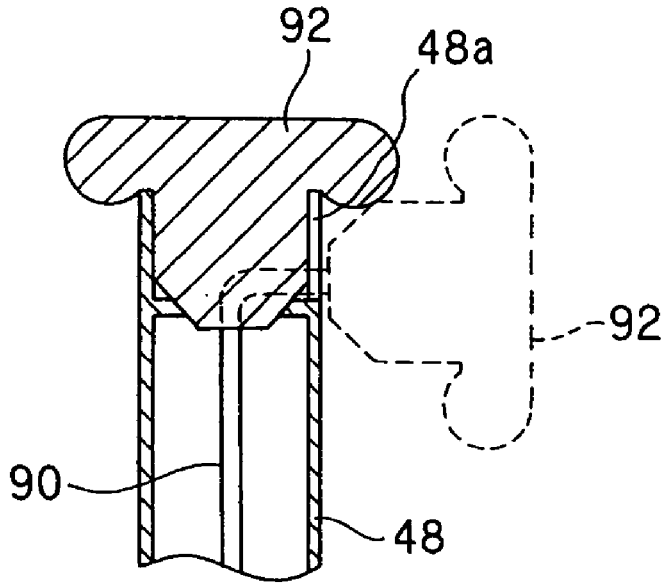
FIG. 9 is a cross section along the line IX—IX in FIG. 8.

FIG. 8 is an enlargement of the area around the upper end of the snorkel 48, while FIG. 9 is a cross section along the line IX—IX in FIG. 8. As shown in FIGS. 8 and 9, a notch 48*a* is provided at the upper end of the snorkel 48 so as to hold the starter grip 92 when removed (as indicated by the broken lines in FIG. 9).

Here, air from the first air tank 22 that is depressurized to a stipulated pressure and supplied to the second passage 12*b* of the main frame 12 is supplied via the communication passage 60*b* to the regulator 68, and also further depressurized by the regulator 68 to the inside pressure of the watertight vessel 14 and then supplied to the interior of the watertight vessel 14 (specifically the drive power enclosure 14*c*).

The air supplied to the watertight vessel 14 passes through an air filter and is taken into the air intake line. The carburetor assembly injects gasoline fuel into the air thus taken in to create a fuel-air mixture. The fuel-air mixture thus created is taken into the combustion chamber (not shown) of engine E and is burned. The exhaust gas generated by the combustion of the fuel-air mixture flows via the exhaust pipe 78 and communication passage 60*c* into the fourth passage 12*d* of the main frame 12.

On the other hand, air from the second air tank 24 that is depressurized to a stipulated pressure and supplied to the third passage 12*c* of the main frame 12 is supplied via the communication passage above and flow path 70, and further supplied via hose 72 to the regulator 74. The regulator 74 is provided with a diaphragm and other components (not shown) so that, when the operator equipped with a mouthpiece 76 inhales, air depressurized to the pressure of the surrounding water is supplied to the operator.

In this manner, with the underwater scooter 10, the first air tank 22 is attached to the main frame 12 and air within the first air tank 22 is supplied as air for use in combustion by the engine E. In addition, the second air tank 24 is also attached to the main frame 12 and the air within the second air tank 24 is supplied as air for use in breathing by the operator.

Figure 10:
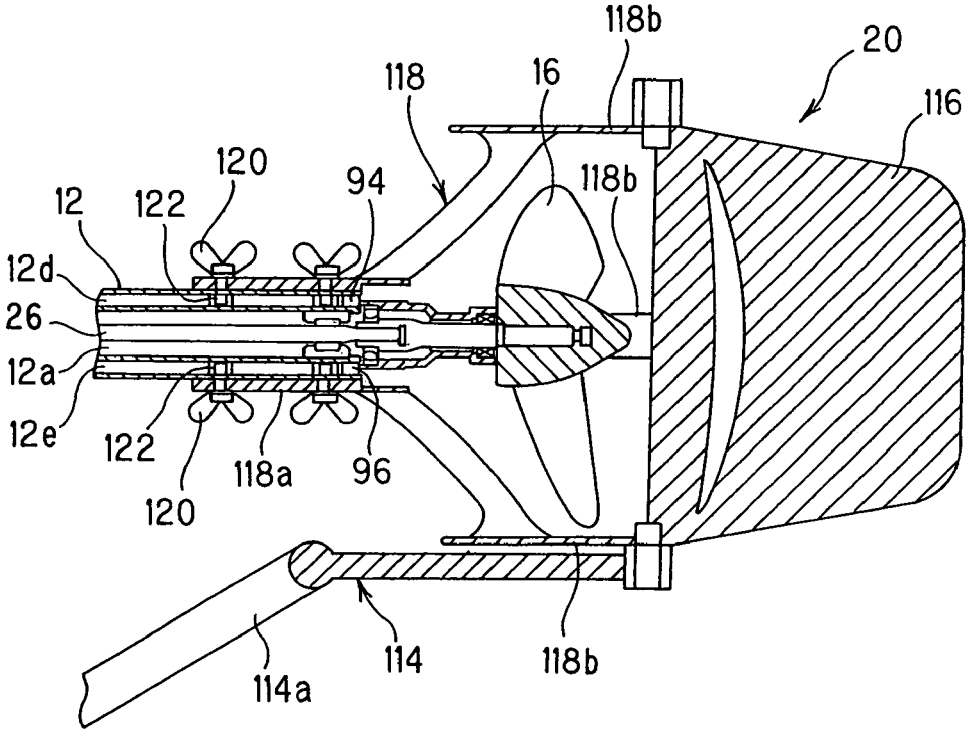
FIG. 10 is an enlarged cross section along the line X—X in FIG. 1.

FIG. 10 is an enlarged cross section along the line X—X in FIG. 1.

As shown in FIG. 10, the propeller 16 is attached to the aft end of the driveshaft 26 passing through the first passage 12*a*. Specifically, at least one of the outputs of the engine E and electric motor M disposed forward of the main frame 12 is transmitted via the driveshaft 26 passing through the interior of the main frame 12 to the propeller 16 disposed aft of the main frame 12, and thus the propeller 16 is driven so that the underwater scooter 10 travels over the surface of the water or underwater.

In addition, a first one-way check valve 94 is disposed at the aft end of the fourth passage 12*d* of the main frame 12. The first one-way check valve 94 opens when exhaust gas flows into the fourth passage 12*d* so that its internal pressure exceeds a stipulated pressure, allowing the fourth passage 12*d* to communicate with the outside (underwater). Specifically, exhaust gas from the engine E is exhausted via the exhaust pipe 78, communication passage 60*c*, the fourth passage 12*d* of the main frame 12 and the first one-way check valve 94 to the aft (outside) of the underwater scooter 10.

Moreover, a second one-way check valve 96 is disposed at the aft end of the fifth passage 12*e* of the main frame 12. The second one-way check valve 96 opens when the internal pressure of the fifth passage 12*e* (in other words, the internal pressure of the watertight vessel 14 with which the fifth passage 12*e* communicates) exceeds a stipulated pressure, allowing the fifth passage 12*e* to communicate with the outside (underwater). Specifically, when the internal pressure of the watertight vessel 14 rises due to heat from the engine E or the like, the air within the watertight vessel 14 is exhausted via the communication passage formed in the connecting member 60, the fifth passage 12*e* of the main frame 12 and the second one-way check valve 96 to the aft (outside) of the underwater scooter 10, and thus the internal pressure of the watertight vessel 14 is regulated (depressurized).

As illustrated above, the first passage 12*a* formed in the main frame 12 serves as the passage of the driveshaft 26. In addition, the second passage 12*b* serves as the flow path for air for combustion to be supplied to the engine E, namely becoming the air intake system for the engine E. The third passage 12*c* serves as the flow path for air for breathing to be supplied to the operator, namely becoming the system for supplying air for breathing. Moreover, the fourth passage 12*d* serves as the flow path for exhaust gas exhausted from the engine E, namely becoming the exhaust system for the engine E. The fifth passage 12*e* becomes a communication path for exhausting air within the watertight vessel 14 (the space enclosing the engine E) to the outside, namely becoming the internal pressure regulation system.

Note that while this is not shown, the second passage 12*b* and the third passage 12*c* are sealed at the aft end of the main frame 12. The second passage 12*b* and the third passage 12*c* are sealed at the aft end of the main frame 12 in order to fill the main frame 12 with air from the fore end to the aft end and give uniform buoyancy to the entire main frame 12. The one-way check valves of each of the fourth passage 12*d* and fifth passage 12*e* are disposed at the aft ends of each for the same reason.

Returning to the description of FIGS. 1–3, the depth adjusting mechanism 18 that adjusts the depth of travel of the underwater scooter 10 so that it either surfaces or dives is attached to the watertight vessel 14. The depth adjusting mechanism 18 comprises a handlebar 100, left and right cylindrical grips 102L and 102R, left and right elevators 104L and 104R comprising plates that are substantially trapezoidal in shape when viewed from above, and connector members 106L and 106R that connect the grips 102L and 102R to the elevators 104L and 104R.

To describe the depth adjusting mechanism 18 in detail, the handlebar 100 is attached to the watertight vessel 14, being disposed such that its lengthwise direction is parallel to a direction lateral to the underwater scooter 10. The left grip 102L is attached to the end of the handlebar 100 on the left side when viewed in the direction of forward motion. Similarly, the right grip 102R is attached to the end of the handlebar 100 on the right side when viewed in the direction of forward motion. Note that each of the left and right grips 102L and 102R is attached so that it is able to turn (specifically, rotate) freely around the handlebar 100 as the center of rotation.

The elevators 104L and 104R are connected to the left and right grips 102L and 102R, via the respective connector members 106L and 106R. Thereby, the elevators 104L and 104R are disposed on either side of the watertight vessel 14 and are able to swivel freely around a lateral axis with respect to the underwater scooter 10. Specifically, by rotating the grips 102L and 102R, it is possible to vary the magnitude of inclination and orientation of the elevators 104L and 104R around a lateral axis with respect to the underwater scooter 10, and thus adjust the buoyancy (forces that causes the underwater scooter 10 to dive or surface) acting on the elevators 104L and 104R.

In addition, the aforementioned throttle lever 108, an accelerator lever 110 for the electric motor M and an emergency switch 112 (all shown in FIGS. 1 to 3) are provided at an appropriate position on the handlebar 100. The throttle lever 108 is mechanically connected to the throttle valve of the engine E and opens/closes the throttle valve in response to the manipulation of the operator. The accelerator lever 110 for the electric motor M is electrically connected to the control unit C and generates a signal in response to the instruction to start or stop the electric motor M inputted by the operator through his lever manipulation. The emergency switch 112 is electrically connected to the control unit C and one end of an emergency cord 112*a* that serves as an on/off trigger is attached to the emergency switch 112. The other end of the emergency cord 112*a* is attached to the wrist of the operator as described later.

On the other hand, the steering mechanism 20 is attached to the aft end of the main frame 12. The steering mechanism 20 comprises a foot stand 114, a rudder 116 connected to the foot stand 114 and a connecting member 118 that connects them to the main frame 12.

To describe the steering mechanism 20 in detail, the connecting member 118 is provided with a cylindrical portion 118*a* with an inside diameter roughly equal to the diameter of the main frame 12. As shown in FIG. 10, the aft end of the main frame 12 is inserted into the cylindrical portion 118*a* of the connecting member 118 and wing bolts 120 are screwed into nuts 122 enclosed in the interior of the main frame 12 to mount the connecting member 118, or in other words, the steering mechanism 20 to the main frame 12. Note that while this is not shown, the nuts 122 like the aforementioned nuts 62 are surrounded by the partition walls on all sides, and are thus kept from turning.

The connecting member 118 is provided with a total of four vanes 118*b* (top, bottom, left and right) connected to the aforementioned cylindrical portion 118*a*. The vanes 118*b* are formed so as to avoid contact with the propeller 16 in either the vertical direction or the lateral direction and also their aft ends are positioned further aft of the propeller 16. The aforementioned foot stand 114 and the rudder 116 connected to it are supported such that they are able to swivel freely around a vertical axis at the aft ends of the two of the vanes 118*b* disposed at the top and bottom. Specifically, by manipulating the foot stand 114 (rotating it around a vertical axis), the rudder 116 can be made to swivel around a vertical axis, thus adjusting the direction of forward motion of the underwater scooter 10.

Figure 11:
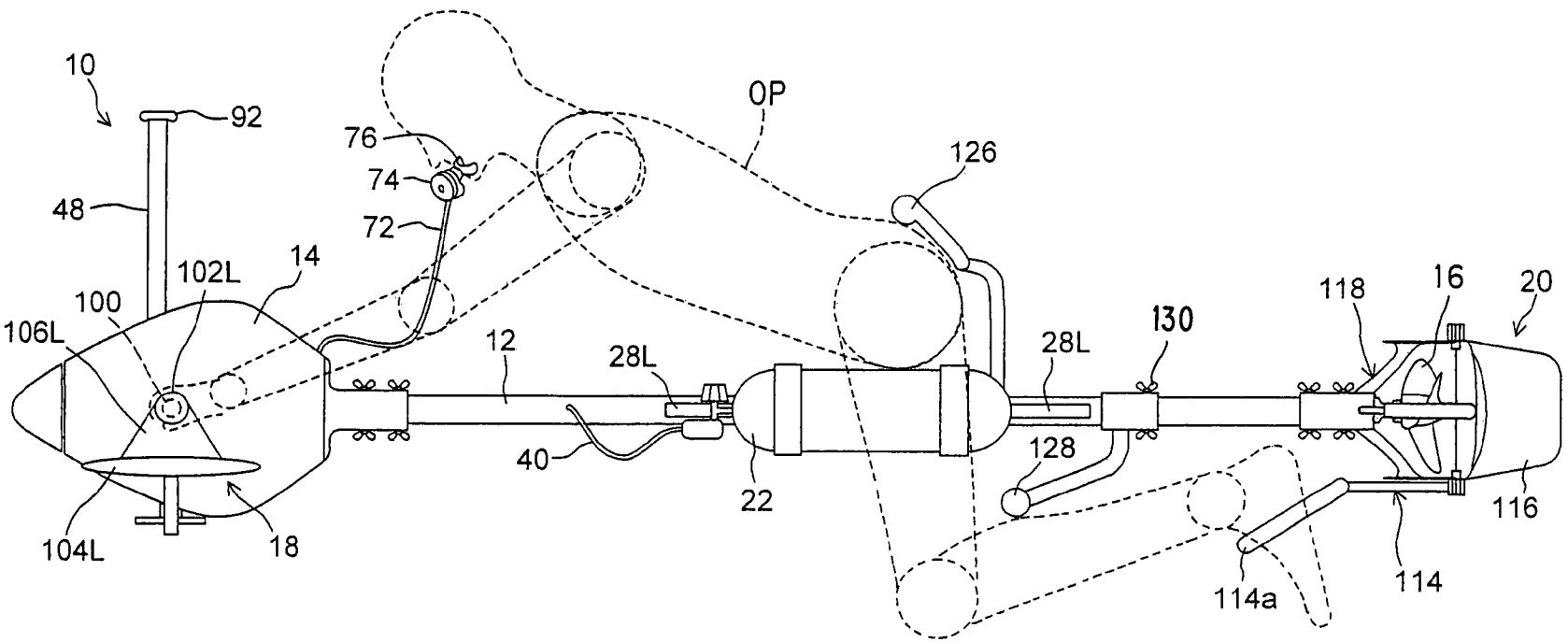
FIG. 11 is a left-side view of the underwater scooter with an operator riding thereon, shown in FIG. 1.

FIG. 11 is a left-side view of the underwater scooter 10 and the operator riding it.

As shown in FIG. 11, the operator OP rides above the first air tank 22 and the second air tank 24. Specifically, the operator OP is seated upon the first air tank 22 and the second air tank 24 so as to straddle the main frame 12. Taking a forward-inclined posture, the operator holds onto the forward-positioned left and right grips 102L and 102R and also places their feet upon the aft-positioned footrest 114*a* of the foot stand 114, or specifically, rests the backs of their feet there. Note that the footrest 114*a* is annular in shape in a top view, as shown on FIG. 1.

At this time, the waist W of the operator OP is supported by a waist holder 126 fixed to the sliders 30L and 30R. The areas near the back of the knees of the operator OP touch and are supported by a leg rest 128. Like the connecting member 60, etc., the leg rest 128 is attached by nuts (enclosed in the interior of the main frame 12 and kept from turning) and screwing wing bolts 130 into the nuts.

One end of the aforementioned emergency cord 112*a* (omitted from FIG. 11) is worn on the wrist of the operator OP. Thereby, should the operator OP fall off of the underwater scooter 10, the other end of the emergency cord 112*a* will be pulled out of the emergency switch 112, and an emergency shutdown signal is sent to shut down the engine E.

Figure 12:
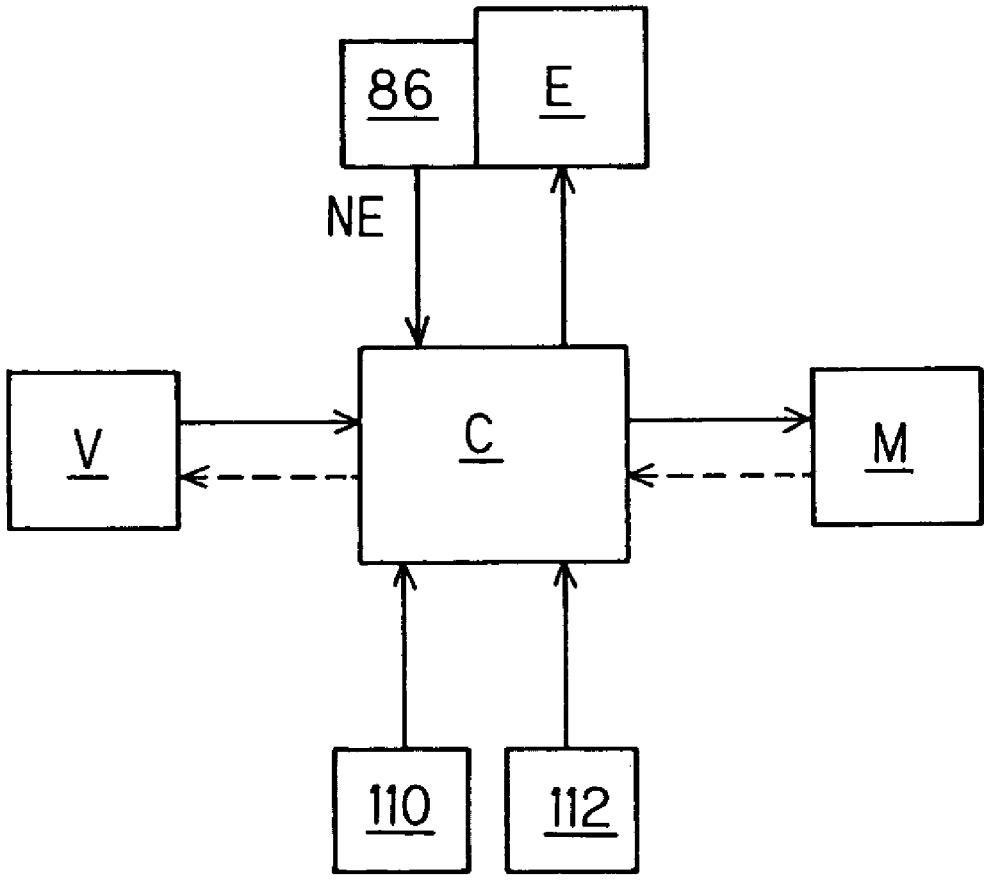
FIG. 12 is a block diagram functionally showing the input and output relationship of the control unit shown in FIG. 5.

Here, the operation of the control unit C will be explained with reference to FIG. 12. FIG. 12 is a block diagram showing the input and output relationship of the control unit C in a functional manner.

As shown in FIG. 12, the control unit C is inputted with the output of the crank angle sensor 86 (i.e., the engine speed NE), the output of the accelerator lever 110 for the electric motor M and the output of the emergency switch 112.

When the instruction to start the electric motor M is inputted to the control unit C through the accelerator lever 110, the control unit C regulates the direction and magnitude of current to be supplied to the coils of the electric motor M and rotates the rotor MR at a speed corresponding to the manipulation of the accelerator lever 110. On the other hand, when the instruction to stop the electric motor M is inputted to the control unit C through the accelerator lever 110, the control unit C terminates the current supply to the coils to stop the rotation of the rotor MR.

In addition, the control unit C starts the electric motor M to generate assist torque, irrespectively of the output of the accelerator lever 110, when the engine speed NE is determined to be within a first predetermined range (more specifically when the engine speed NE is determined to be greater than an engine speed beneath of which the output torque of the engine E drops (i.e., has peaked)). On the contrary, the control unit C operates the electric motor M as a generator to charge the battery V, when the engine speed NE is determined to be within a second predetermined range (more specifically when the engine speed NE is determined to be at an engine speed at which the output torque of the engine E becomes maximum or thereabout).

In addition, when the emergency stop signal is inputted from the emergency switch 112, the control unit C terminates the current supply to the motor coils to stop the rotation of the rotor MR of the electric motor M and at the same time, stops the engine E by discontinuing ignition or the like, such that the underwater scooter 10 stops running.

Here follows a description of how the operator OP operates the underwater scooter 10, or specifically how the depth of travel and direction of motion are adjusted.

Figure 13:
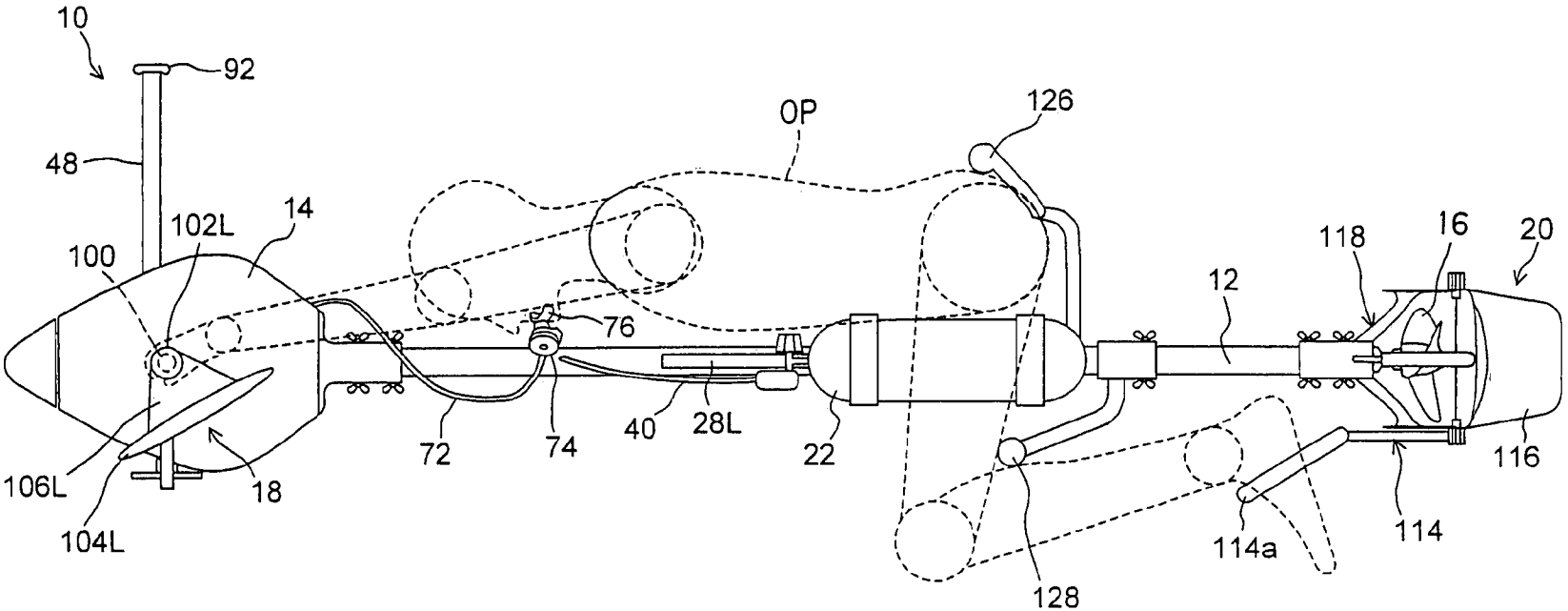
FIG. 13 is also a left-side view of the underwater scooter with the operator riding thereon, shown in FIG. 1.

First, to make the underwater scooter 10 dive, as shown in FIG. 13, the left and right grips 102L and 102R are rotated so that the left and right elevators 104L and 104R are positioned with their fore edges below their aft edges. When the underwater scooter 10 moves forward in this state, a downward force acts on the left and right elevators 104L and 104R, causing the underwater scooter 10 to dive. In addition, at this time, the operator OP slides the first and second air tanks 22 and 24 serving as the saddle area toward the aft. Namely, the position at which the buoyancy of the first and second air tanks 22 and 24 acts is shifted toward the aft. Thereby, the buoyancy of the aft part of the underwater scooter 10 becomes greater and the fore part of the underwater scooter 10 sinks down (the aft part floats up), thus assuming a posture suited to diving (making diving easier).

Figure 14:
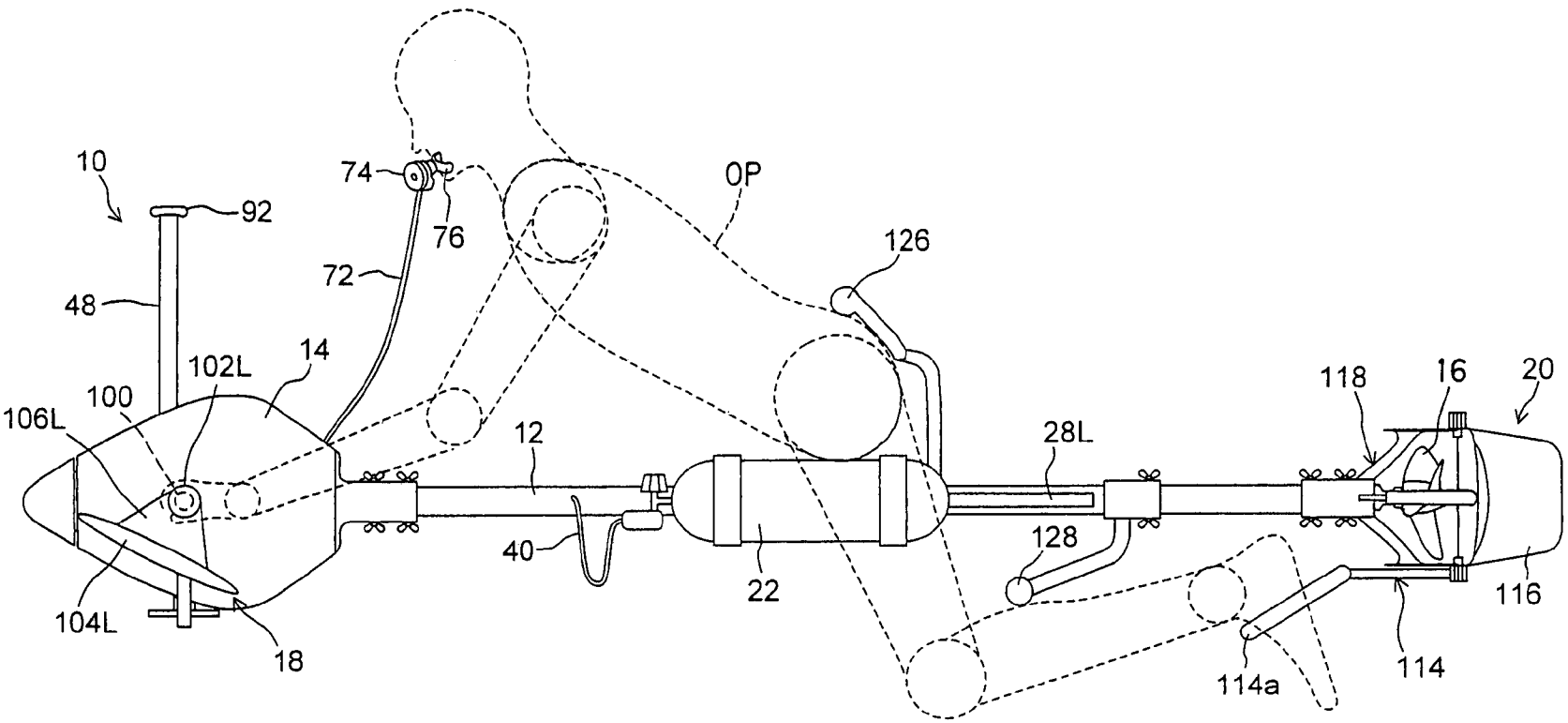
FIG. 14 is also a left-side view of the underwater scooter with the operator riding thereon, shown in FIG. 1.

In contrast, to make the underwater scooter 10 surface, as shown in FIG. 14, the left and right grips 102L and 102R are rotated so that the left and right elevators 104L and 104R are positioned with their fore edges above their aft edges. When the underwater scooter 10 moves forward in this state, an upward force acts on the left and right elevators 104L and 104R, causing the underwater scooter 10 to surface. In addition, at this time, the operator OP slides forward the first and second air tanks 22 and 24 serving as the saddle area. Namely, the position at which the buoyancy of the first and second air tanks 22 and 24 acts is shifted toward the fore. Thereby, the buoyancy of the fore part of the underwater scooter 10 becomes greater and the fore part of the underwater scooter 10 floats up (the aft part sinks down), thus assuming a posture suited to surfacing (making it easier to surface).

To adjust the direction of forward motion of (steer) the underwater scooter 10, if the foot stand 114 is manipulated by the operator in the right or left direction such that the rudder 116 is swiveled about the vertical shaft. With this, the operator can steer the underwater scooter in the right or left direction as desired.

In this manner, the underwater scooter 10 according to the embodiment of the present invention has the engine E enclosed in the watertight vessel 14 and the electric motor M enclosed in the watertight vessel 14 and connected to the output shaft (crankshaft ES) of the engine, and the propeller 16 disposed upon the main frame and connected to the output shaft (rotor MR) of the electric motor to be driven and turned by at least one of the engine and the electric motor so as to propel the underwater scooter. In other words, the underwater scooter is a hybrid type having the engine E and electric motor M as the drive power of the propeller 16. With this, the operator can easily re-start, once stopped on the surface of the water or underwater. Moreover, since the propeller 16 can be driven even by the engine E, a distance of travel is elongated with less increased weight (battery capacity), when compared to the case that the propeller 16 is driven solely by the engine E.

In addition, since the battery V can be charged if the electric motor M is operated as the generator when the propeller 16 is driven by the engine E. This can eliminate or reduce the battery charging time (this usually takes one to several hours).

In addition, since the electric motor M is connected to the crankshaft ES of the engine E via the centrifugal clutch 84, it becomes possible to stop the travel of the scooter while running the engine E. With this, after the scooter 10 is once stopped on the surface of the water or underwater, it can resume the running or travel easily by the output of the engine E. When the propeller 16 is driven by the electric motor M alone, since the electric motor M can be disconnected from the engine E, the load of the motor M can be reduced, rendering to save electric energy consumption.

In addition, since the battery V and control unit C (that are relatively heavy) are placed in the watertight vessel 14 at a position below the engine E and electric motor M, thereby enabling to improve the stability and steering of the underwater scooter 10.

In addition, the first and second air tanks 22 and 24 serving as the saddle area are attached to the main frame 12 such that the operator can seat upon the first and second air tanks 22 and 24 so as to saddle the main frame 12, so the burden on the operator can be reduced in comparison to that of conventional types that tow the operator.

In addition, the air filled in the first air tank 22 is supplied to the engine E to be used for combustion, whilst the air filled in the second air tank 22 is supplied to the operator for breathing, so that it is possible to travel both upon the surface of the water and underwater and the comfort of the operator can be improved.

In addition, the first and second air tanks 22 and 24 can slide freely in the direction of forward motion so as to enable to vary the position at which buoyancy of the tanks 22 and 24 acts, so the position of the scooter can be adjusted optimally for diving or surfacing, so the depth of travel can be easily adjusted, thus further reducing the burden on the operator OP.

The embodiment is thus configured to have an underwater scooter 10 on which an operator (OP) is seated to operate so as to travel on a surface of water or underwater, comprising: a main frame 12 on which the operator is to be seated; a watertight vessel 14 disposed upon the main frame; an internal combustion engine E enclosed in the watertight vessel; an electric motor M enclosed in the watertight vessel and connected to an output shaft (crankshaft ES) of the engine; and a propeller 16 disposed upon the main frame and connected to an output shaft (rotor MR) of the electric motor to be driven and turned by at least one of the engine and the electric motor so as to propel the underwater scooter.

In the underwater scooter, the electric motor M is connected to the output shaft of the engine via a centrifugal clutch 84.

The underwater scooter further includes: a battery V supplying voltage to the electric motor; and a control unit C controlling the operation of the electric motor; wherein the battery and the control unit are located at positions below the engine and the electric motor in the direction of gravity.

The underwater scooter further includes; a depth adjusting mechanism 18 disposed near the watertight vessel and adjusting a depth of travel of the underwater scooter, or a steering mechanism 20 disposed near the propeller and adjusting a direction of forward motion of the underwater scooter, or an air tank (first air tank 22, second air tank 24) disposed upon the main frame between the watertight vessel and propeller such that the operator is seated thereon.

Note that in the above, when the underwater scooter 10 is traveling upon the surface of the water or near the surface (namely when the depth of travel is shallow and the upper end of the snorkel 48 is positioned above the surface of the water), the starter grip 92 may be removed from the upper end of the snorkel 48 and held in the notch 48*a* described above (namely so that it does not seal the opening) so that outside air can be taken in as the air used for combustion in the engine E. At this time, the valve 36 connected to the first air tank 22 can be closed so that the supply of air from the first air tank 22 is halted, and thus the consumption of air contained in the tank can be reduced.

Moreover, the snorkel 48 may be connected to the mouthpiece 76 so if the depth of travel of the underwater scooter 10 is shallow, the air for breathing by the operator can also be introduced from outside. At this time, the valve 42 connected to the second air tank 24 may be closed, cutting off the supply of air from the second air tank 24, so the consumption of air contained in the tank can be similarly reduced.

Japanese Patent Application No. 2004-116156 filed on Apr. 9, 2004 is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An underwater scooter operable to enable an operator seated thereon to travel on a surface of water or underwater, said underwater scooter comprising:

a main frame on which the operator is to be seated;

a watertight vessel disposed upon the main frame;

an internal combustion engine enclosed in the watertight vessel;

an electric motor enclosed in the watertight vessel and connected to an output shaft of the engine; and a propeller rotatably disposed upon the main frame and connected to an output shaft of the electric motor wherein the propeller is adapted to be driven and turned by at least one of the engine and the electric motor so as to propel the underwater scooter.

2. The underwater scooter according to claim 1, wherein the electric motor is operatively connected to the output shaft of the engine via a centrifugal clutch.

3. The underwater scooter according to claim 1, further including:

a battery for supplying voltage to the electric motor; and a control unit for controlling the operation of the electric motor;

wherein the battery and the control unit are located at positions below the engine and the electric motor.

4. The underwater scooter according to claim 1, further including;

a depth adjusting mechanism disposed near the watertight vessel and provided for adjusting a depth of travel of the underwater scooter.

5. The underwater scooter according to claim 1, further including:

a steering mechanism disposed near the propeller and operable to adjust a direction of forward motion of the underwater scooter.

6. The underwater scooter according to claim 1, further including: an air tank disposed upon the main frame between the watertight vessel and propeller and configured such that the operator may be seated thereon.

* * * * *